US007299685B1

(12) United States Patent
Burnett

(10) Patent No.: US 7,299,685 B1
(45) Date of Patent: Nov. 27, 2007

(54) GOLF BALL EQUATOR LOCATING APPARATUS

(75) Inventor: Kenneth Burnett, Lincolnwood, IL (US)

(73) Assignee: Technasonic Electronics, Inc., Lincolnwood, IL (US)

( * ) Notice: Subject to any disclaimer, the term of this patent is extended or adjusted under 35 U.S.C. 154(b) by 196 days.

(21) Appl. No.: 11/319,138

(22) Filed: Dec. 27, 2005

(51) Int. Cl.
*G01M 1/00* (2006.01)
*A63B 55/00* (2006.01)

(52) U.S. Cl. ..... 73/65.02; 73/65.03; 101/38.1

(58) Field of Classification Search ..... 73/65.02, 73/65.03, 65.07, 65.09; 101/35, 38.1
See application file for complete search history.

(56) References Cited

U.S. PATENT DOCUMENTS 4,546,644 A 10/1985 Beny et al.
4,804,220 A 2/1989 Rosheim
D301,554 S * 6/1989 Ogawa ..... D10/82
4,974,511 A * 12/1990 Hsi-Chou ..... 101/38.1
D323,301 S * 1/1992 Cheng ..... D10/82
5,611,723 A 3/1997 Mitoma et al.
5,705,740 A * 1/1998 Unno et al. ..... 73/65.09
6,085,578 A * 7/2000 Tanaka et al. ..... 73/65.02
6,165,049 A 12/2000 Yamaguchi
6,453,807 B1 * 9/2002 Ramey ..... 101/35
6,813,936 B2 11/2004 Burnett
7,047,877 B2 * 5/2006 Powney et al. ..... 101/35

* cited by examiner

*Primary Examiner*—Michael Cygan
*Assistant Examiner*—Punam Patel
(74) *Attorney, Agent, or Firm*—Adam K. Sacharoff; Much Shelist

(57) ABSTRACT

An apparatus for locating and marking an equator of a golf ball is provided and includes a rotation plate shaped to support a golf ball is provided in a housing. The housing encloses a motor and the motor is attached to the rotation plate and is capable of imparting spin on the rotation plate. A guard has a ring and a cross-beam with a marking opening defined therein extending from the ring. The bottom portion of the housing includes a cavity shaped to accommodate the golf ball such that any markings made to the ball may be darkened and better defined.

16 Claims, 6 Drawing Sheets

GOLF BALL EQUATOR LOCATING APPARATUS

FIELD OF THE INVENTION

The present invention provides an apparatus for locating and marking the equator of a golf ball.

BACKGROUND OF THE INVENTION

Locating and marking the equator of a golf ball is necessary since, as a result of the methods and materials used to manufacture golf balls, many of the balls exhibit imperfections in their center of gravity. Oftentimes, the center of gravity of a golf ball is offset from the geometric center of the ball. These imperfections result in unpredictable behavior in the path of the ball upon rolling or striking it.

By locating the equator of each golf ball, a player can attain the truest path of travel by lining the equator up with the target and striking the ball perpendicular to the equator. This works equally well whether putting or driving the golf ball. The apparatus of the present invention provides a quick and easy way to mark the equator of the ball. The apparatus utilizes a motor in a housing to spin the golf ball in order to locate the equator. Numerous ways to supply power to and control the motor are also provided.

Applicant's other patents such as U.S. Pat. No. 6,813,936 which is incorporated herein by reference is directed to a similar equator golf ball apparatus. However, the '936 patent does not address all the problems and issues that the present invention addresses. Only after Applicant began using its own invention did the additional problems and issues become apparent.

SUMMARY OF THE INVENTION

In accordance with the present invention an apparatus for locating and marking the equator of a golf ball is provided. The apparatus includes a housing having a top portion and a bottom portion. A plate is provided and shaped to support the golf ball. A motor is attached to the plate and is capable of spinning the plate with the golf ball thereon such that the golf ball will move into a stable alignment. An annular guard is positioned on the top portion of the housing to provide a marking opening that is positioned at a distance substantially about the equator of the golf ball when the golf ball is supported on the plate. The marking opening is sized to receive a marking instrument to mark the golf ball about the equator when the golf ball is spinning in stable alignment. Lastly, a cavity is positioned on the bottom portion of the housing and is sized to receive a golf ball. The cavity has an edge and a depth to accommodate the golf ball preferably to a predetermined depth. At least a portion of the marked equator of the golf ball may then be aligned within the cavity such that the portion of the markings on the golf ball aligns with the edge of the cavity. The marking instrument is then able to be used a second time to mark over the marked equator of the golf ball.

In addition, the apparatus may also include a means to indicate that the golf ball is spinning in stable alignment. This could include a light indicating source or audible source.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
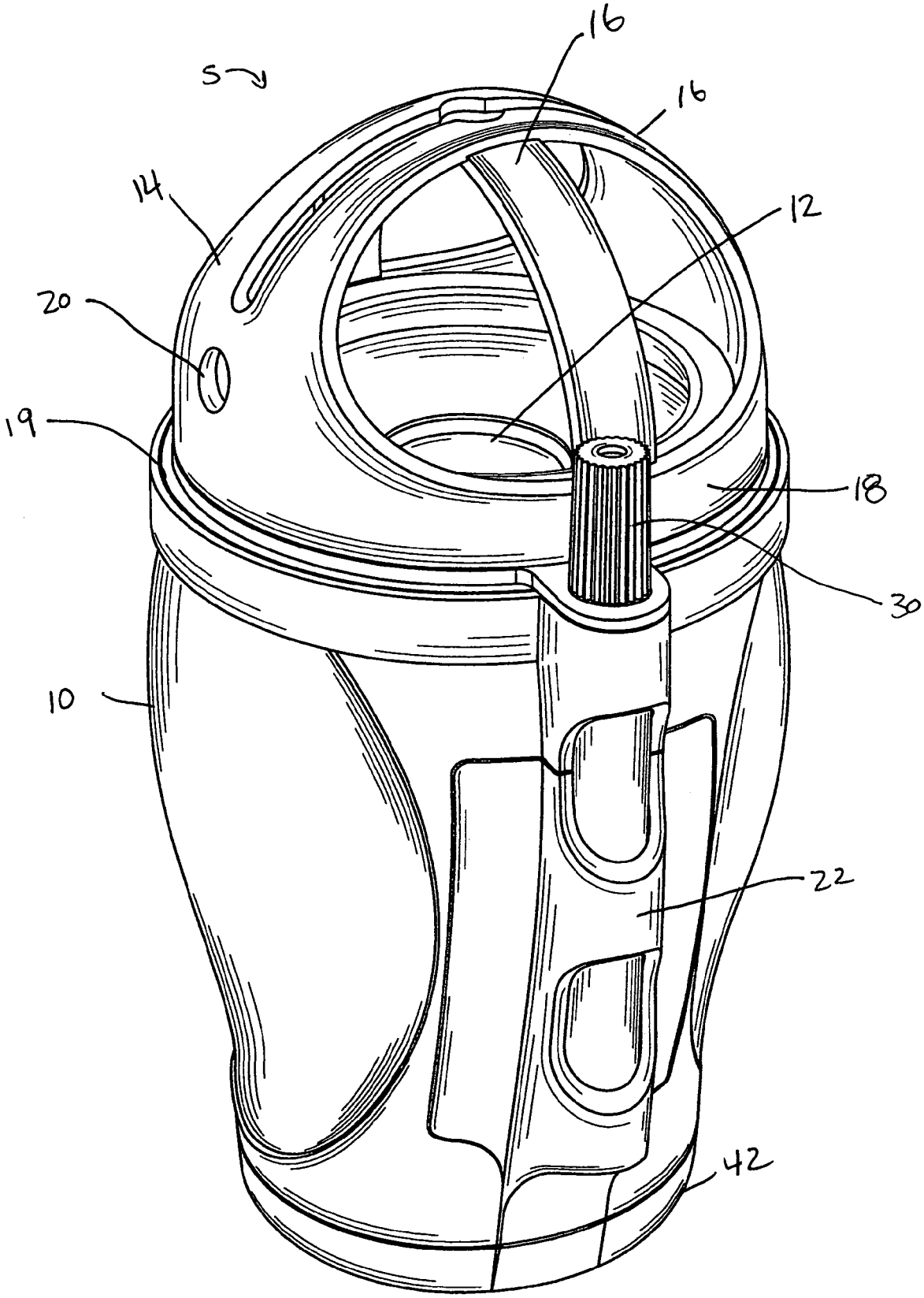
FIG. 1 is a perspective view of an embodiment of the present invention.
Figure 2:
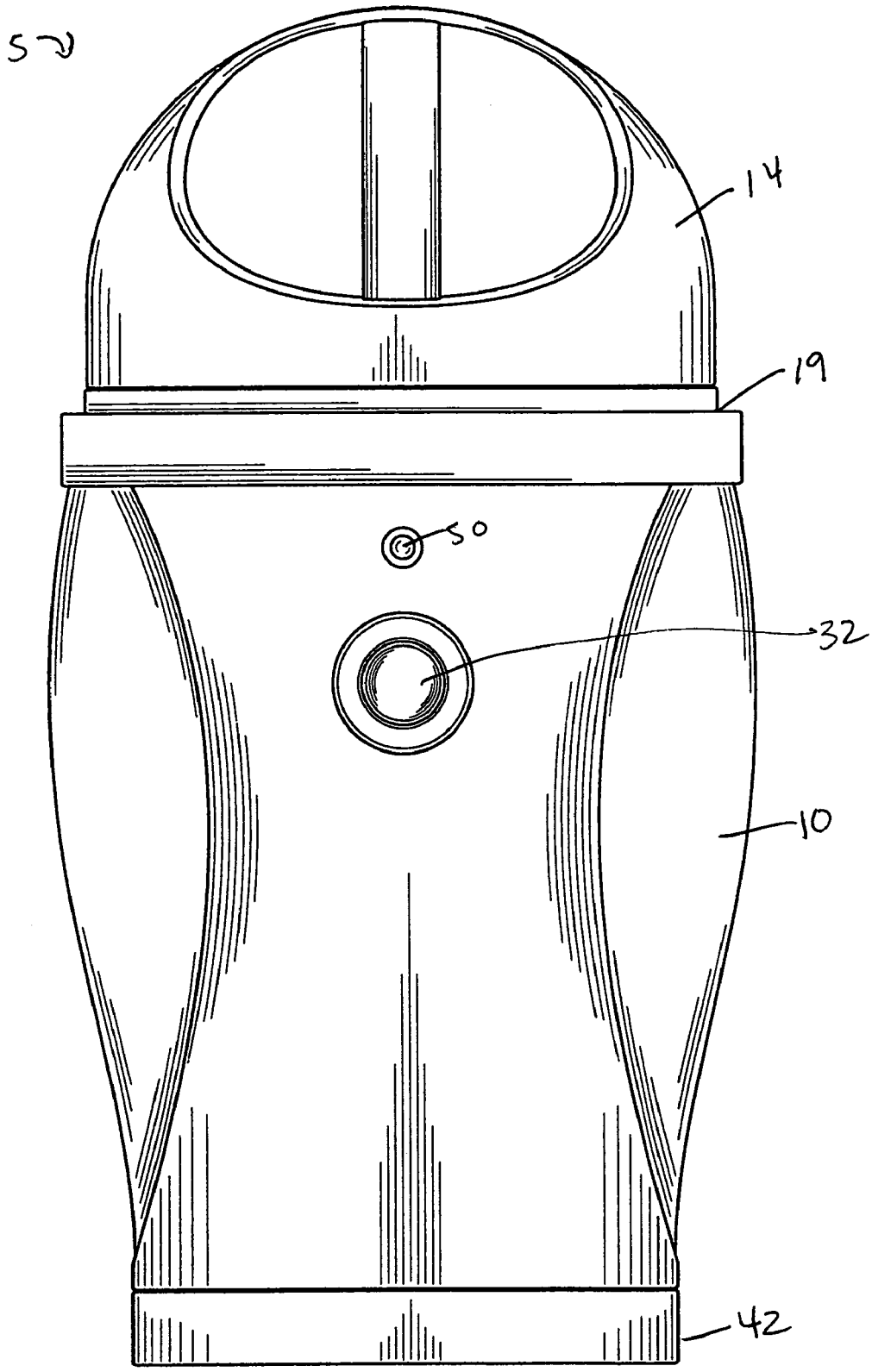
FIG. 2 is a side view of the embodiment of FIG. 1 showing a light indicating mechanism.
Figure 3:
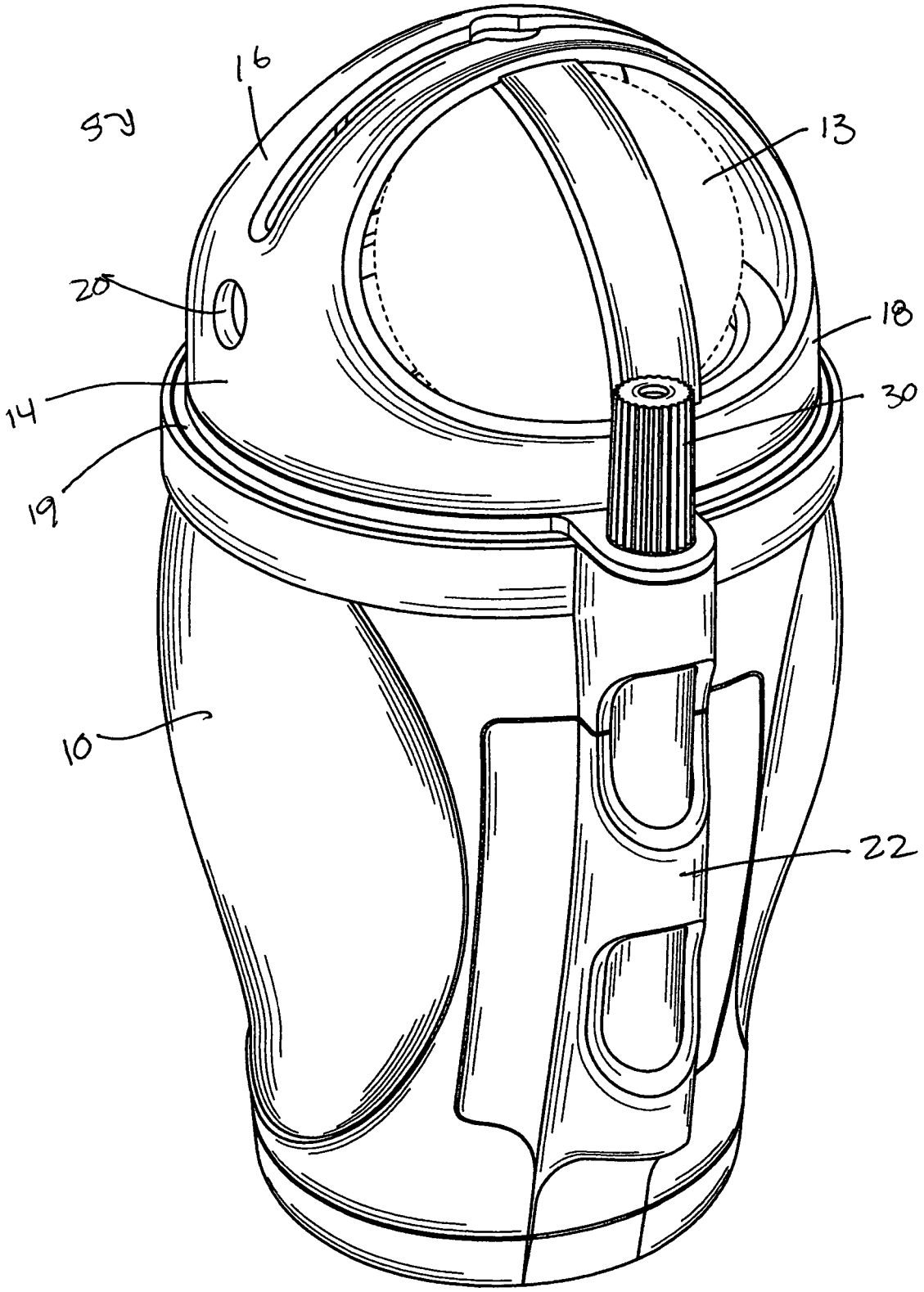
FIG. 3 is a perspective view of FIG. 1 showing the golf ball resting on the plate within the guard.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring to FIGS. 1-5, a first preferred embodiment of the present invention is illustrated. Preferably, the apparatus 5 has a housing 10 that encloses a motor (not shown) that is connected to a plate 12. The motor is connected such that the plate spins with the motor is activated. The plate 12 is preferably formed from a material that allows the golf ball 13 to spin on the plate 12 yet not become completely dislodged from the plate 12. The motor preferably spins the plate 12 at several thousand RPM.

Preferably, the apparatus of the present invention has a guard 14 positioned on the housing 10 over the plate 12. The guard 14 preferably has a pair of cross-beams 16. The cross-beams 16 are attached to a ring 18 having a circumference large enough to fit into a top portion 19 of the housing 10. The guard 14 is preferably removable.

One of the cross-beams 16 has a side marking opening 20. The side marking opening 20 is preferably positioned such that the equator of a golf ball 13 is substantially aligned with the opening 20 when a golf ball 13 is placed on the plate 12. The diameter of the opening 20 is preferably sized such that the tip of a marker 30 can fit through the opening 20 and come into contact with the outer diameter of a golf ball 13 when placed on the plate 12. The opening 20 also preferably prevents the marker from moving the golf ball 13 off-center.

The apparatus of the present invention also preferably includes a holder 22 defined on one side of the housing 10 sized to hold the marker 30 when it is not in use.

Many different means may be used to control the supply of power to the motor. In one embodiment a battery compartment (not shown) is provided for the insertion of two AA dry-cell batteries (not shown). Other types of batteries could be used. In an alternative embodiment a power cord is provided in order to connect the apparatus to an external AC power source (not shown).

The apparatus of the present embodiment also preferably includes a means for controlling the motor. If a power cord is used, the circuit is always complete, and the motor turns on when the power cord is connected to the external power source. Alternatively, a button 32 may be provided in order to complete the circuit and turn the motor on. In order to complete the circuit and impart spin on the golf ball 13, an operator presses on the button 32.

The apparatus of the present embodiment provides a compact, easy way to locate the equator of a golf ball 13. In operation, an operator places a golf ball 13 on the plate 12. The guard 14 is placed on the housing 10 and the circuit is completed so that power is supplied to the motor. The motor spins the plate 12, preferably at several thousand RPM. As the plate 12 spins, spin is imparted on the golf ball 13 as well. If the center of gravity of the golf ball 13 is not aligned with the geometric center of the ball 13, internal forces induced by the rotation of the ball 13 will cause the ball 13 to shift in relation to the plate 12 so that the center of gravity of the ball 13 becomes aligned with the axis of rotation of the plate 12. The alignment process preferably takes about 20-40 seconds.

Once the operator observes that the ball 13 has stopped moving relative to the plate 12 and is spinning in a constant position, the ball 13 may be marked. Preferably, while the ball 13 is still rotating, the marker is inserted into the opening 20 in the cross-beam 16 of the guard 14. The marker is preferably held in contact with the surface of the ball 13 until a line is observed on the ball 13 around the entire circumference of the ball 13. At this point, power can be cut off to the motor and the ball 13 is allowed to stop spinning.

The result is a line around the true equator of the golf ball 13. Before striking the golf ball 13, the user can align the equator so that the line is pointing toward the target. The effect is an increase in accuracy and distance when striking the ball 13.

Additionally, and one of the improvements of the present invention is that when marking the ball as explained above, it is often found that the marking instrument bumps off of the ball, slightly, as the tips moves across the dimples of the ball. This causes the marked ball to have an incomplete line of a faded line perhaps only slightly visible to the user. Thus one improvement of the present invention is to provide a means to align the marked golf ball and remark or darken the line previously made.

Figure 4:
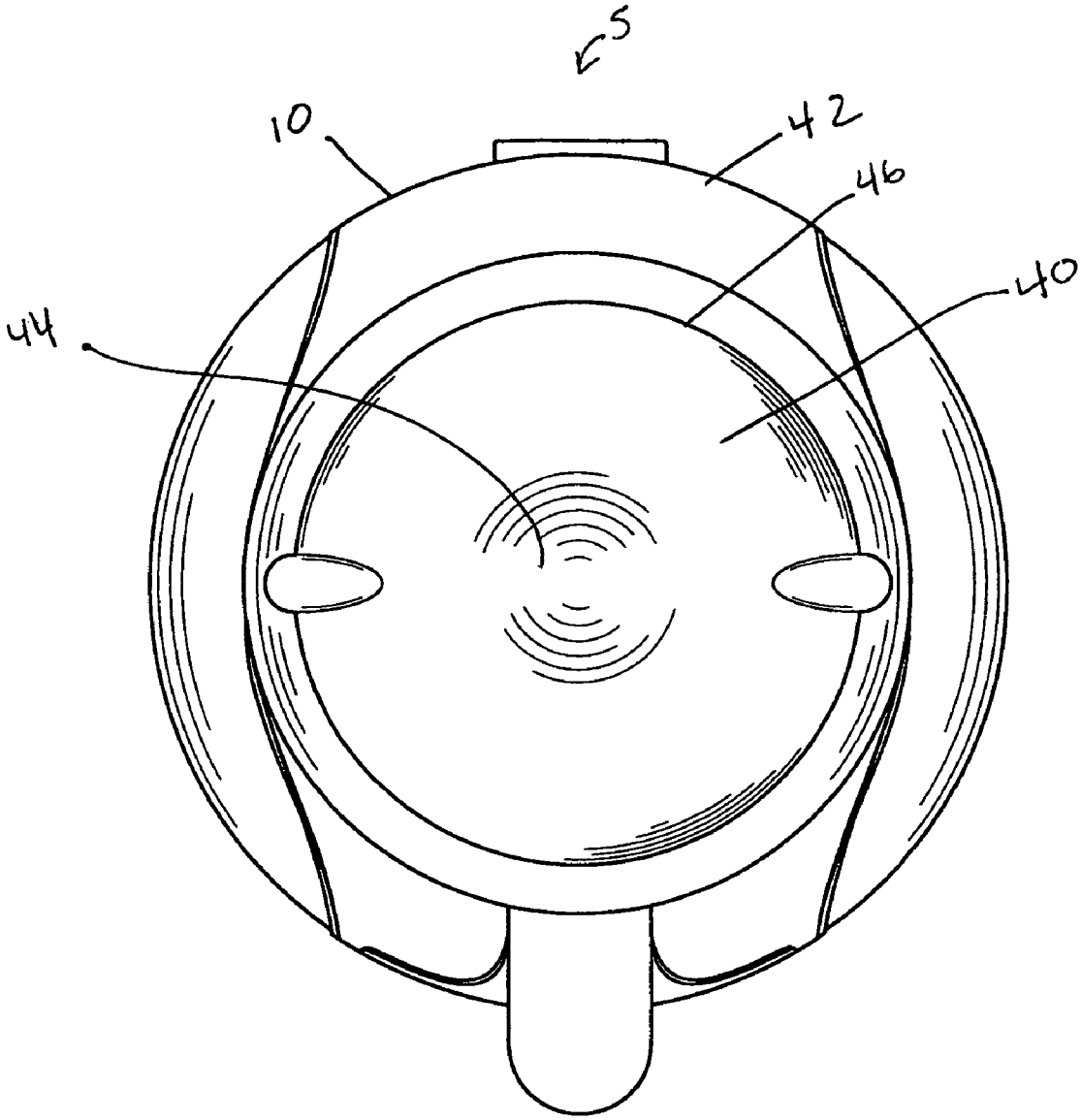
FIG. 4 is a bottom view of FIG. 1 showing the cavity that is able to accommodate the golf ball.
Figure 5:
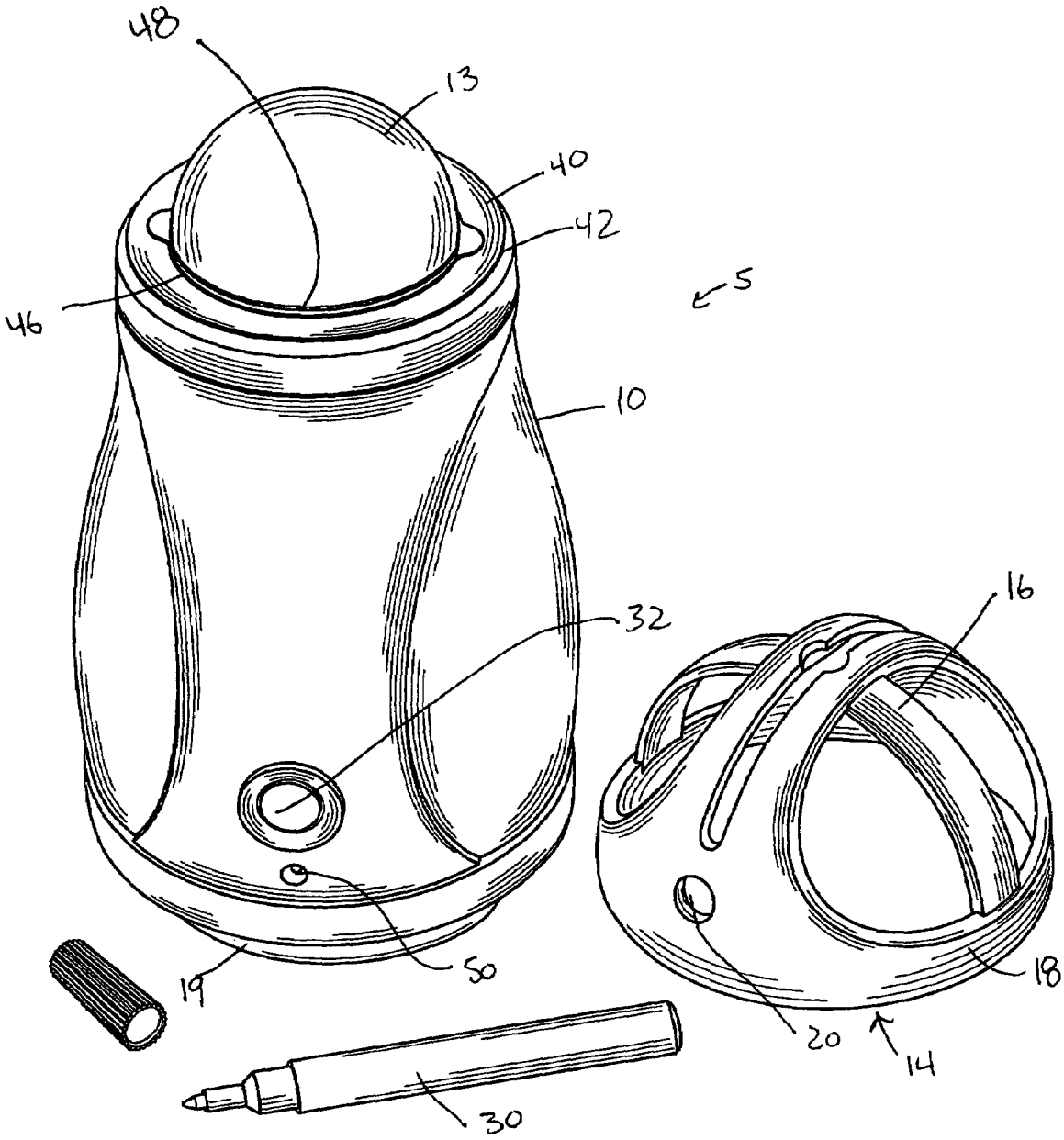
FIG. 5 is a perspective view of FIG. 1 showing the golf ball within the cavity.

As shown in FIGS. 4 and 5, a cavity 40 is provided on the bottom portion 42 of the housing 10. The cavity is preferably shaped to accommodate a golf ball. However, the important aspect of the cavity is that a depth 44 is provided such that a golf ball 13 placed therein would be capable of being aligned such that at least a portion of its marked equator can be aligned with the edge 46 of the cavity 40. Once the equator of ball 13 is initially marked as explained above, the power to the motor is turned off. The guard 14 is removed and the apparatus 5 is turned over resting on its top portion 19. The marked golf ball is placed in the cavity 40 and is aligned such that at least a portion 48 of the golf ball's marked equator is able to be aligned with the edge 46 of the cavity, the marker 30 may be used to darken or remark the portion equator of the ball (as the edge 46 would preferably be placed at a position slightly below the equator).

Figure 6:
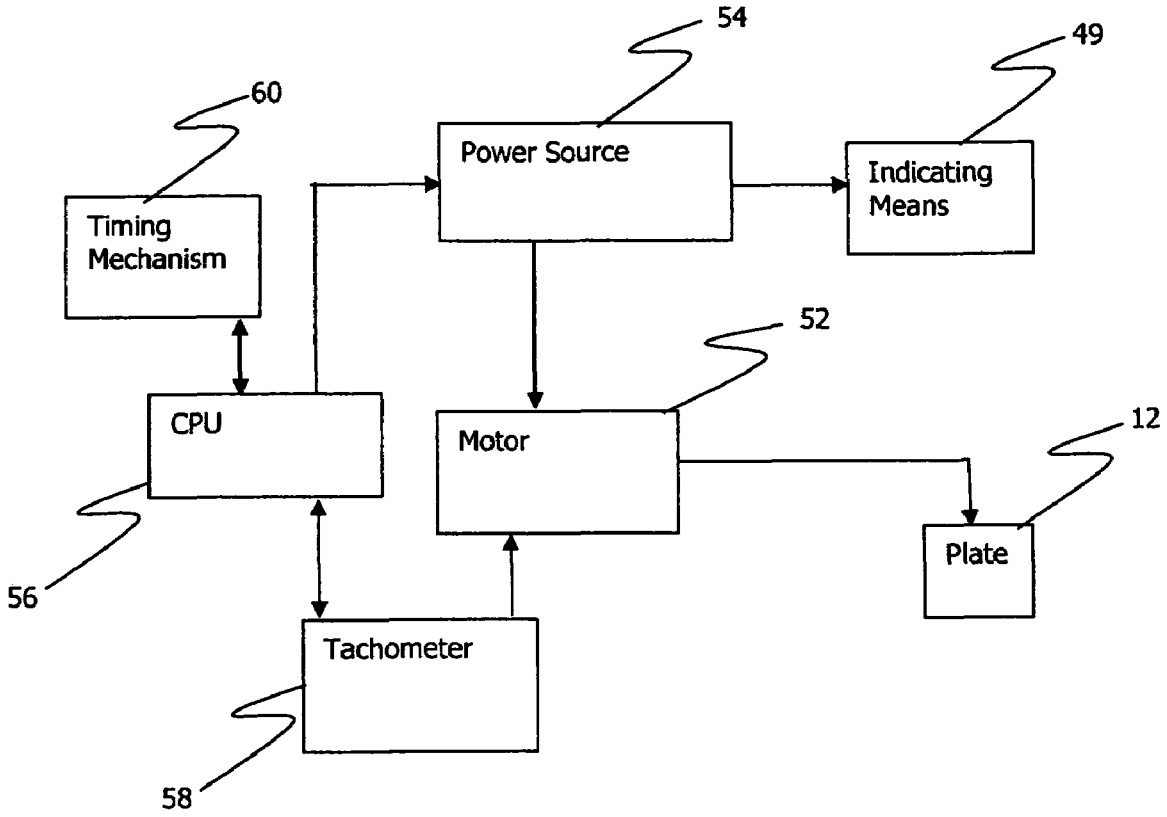
FIG. 6 is a block diagram illustrating the apparatus with an indication mechanism.

Referring now to FIGS. 6, a block diagram is provided to illustrate a further improvement of the apparatus over the prior art. As mentioned above, on average a spinning golf ball will reach its equilibrium and become aligned with the axis of rotation of the plate 12 in about 20-40 seconds. Marking the golf ball 13 prior to this point would not be advantageous because the marking would not be the equator of the golf ball 13. As such the apparatus 5 would be improved if it includes a means to indicate 49 that the golf ball 13 is in stable alignment. While various indication means are contemplated, such as a light source, audible sound or a combination thereof, the embodiments illustrated herein include an LED 50 that is turned on when the golf ball is in stable alignment. As mentioned above, a motor 52 is in communication with the plate 12 and receives its power from a power source 54. The power source 54 would also supply power to the indicating means 49. The power source would be controlled by a processor 56 that would indicate to the power source 54 on when to supply power to the indicating means 49. If the indicating means was an audile sound, a speaker and sound chip would further be included. If however, the indicating means is a lighting source such as an LED, power to the LED can be supplied to turn the LED on and power cut to turn the LED off. The threshold on when to power the indicating means may take the form of various embodiments. First, the threshold may be determined when the motor reaches a predetermined RPM. This may be 2500 RPM, 3000 RPM, somewhat higher or lower. The rationale being that once the motor reaches the predetermined RPM, the golf ball would have sufficient time to reach the stable alignment. To monitor the motor 52, a tachometer 58 is used. Once the motor reaches the predetermined RPM the indicator means is activated.

In a second embodiment, a timing mechanism 60 is employed. The processor 56 would start the timing mechanism 60 when the motor 52 is initiated. Once the timing mechanism 60 reaches a predetermined time the indicating means is activated. The timing mechanism may be restarted if the motor is temporarily stopped and restarted. Such would happen if the user lifted its finger off of the start button 32 momentarily.

In a third embodiment, both the timing mechanism 60 and the tachometer 58 are used. In the third embodiment, once the motor reaches a predetermined RPM, the timing mechanism is started. The indicating means is activated once the timing mechanism reaches a predetermined time. Again, in this embodiment, the timing mechanism may be restarted if the motor drops below the predetermined RPM.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. An apparatus for locating and marking the equator of a golf ball comprising:

a housing having a top portion and a bottom portion;

a plate shaped to support said golf ball;

a motor attached to said plate, said motor capable of spinning said plate with said golf ball thereon to spin said golf ball into stable alignment;

an annular guard positioned on the top portion of said housing, said guard having a marking opening position at a distance substantially about the equator of said golf ball when said golf ball is supported on said plate, said marking opening sized to receive a marking instrument to mark said golf ball about said equator when said golf ball is spinning in stable alignment; and a cavity positioned on the bottom portion sized to receive a golf ball, the cavity having an edge and a depth to accommodate the golf ball wherein at least a portion of the marked equator of the golf ball is able to be aligned with the edge of the cavity such that the marking instrument is able to be used to mark over said portion of the marked equator of the golf ball.

2. The apparatus of claim 1 further comprising:

a means to indicate that the golf ball is spinning in stable alignment.

3. The apparatus of claim 2, wherein the indication means includes a lighting source.

4. The apparatus of claim 3, wherein the indication means includes a timing mechanism in communication with the motor such that the timing mechanism is activated upon the activation of said motor, and said lighting source activates when a predetermined time lapses.

5. The apparatus of claim 3, wherein the indication means includes a tachometer in communication with the motor and said lighting source activates when the motor rotates to a predetermined RPM.

6. The apparatus of claim 3, wherein the indication means includes a timing mechanism and a tachometer, and said lighting source activates when the motor rotates to a predetermined RPM for a predetermined amount of time.

7. An apparatus for locating and marking the equator of a golf ball comprising:

a housing having a top portion and a bottom portion;

a plate shaped to support said golf ball;

a motor attached to said plate, said motor capable of spinning said plate with said golf ball thereon to spin said golf ball into stable alignment;

an annular guard positioned on the top portion of said housing, said guard having a marking opening position at a distance substantially about the equator of said golf ball when said golf ball is supported on said plate, said marking opening sized to receive a marking instrument to mark said golf ball about said equator when said golf ball is spinning in stable alignment; and a means to indicate that the golf ball is spinning in stable alignment, and wherein the indication means includes a tachometer in communication with the motor and said indication means activates when the motor rotates to a predetermined RPM.

8. The apparatus of claim 7 further comprising:

a cavity positioned on the bottom portion sized to receive a golf ball, the cavity having an edge and a depth to accommodate the golf ball wherein at least a portion of the marked equator of the golf ball is able to be aligned with the edge of the cavity such that the marking instrument is able to be used to mark over said portion of the marked equator of the golf ball.

9. The apparatus of claim 7, wherein the indication means includes a lighting source.

10. The apparatus of claim 9, wherein the indication means further includes a timing mechanism in communication with the motor such that the timing mechanism is activated upon the activation of said motor, and said lighting source activates when a predetermined time lapses.

11. An apparatus for locating and marking the equator of a golf ball, the apparatus having a plate and a motor plate for spinning said plate, wherein when a golf ball is placed on the plate the golf ball will spin into a stable alignment such that the spinning golf ball may be marked at its equator, the apparatus further comprising:

a cavity positioned on the bottom portion sized to receive a golf ball, the cavity having an edge and a depth to accommodate the golf ball wherein at least a portion of the marked equator of the golf ball is able to be aligned with the edge of the cavity such that the marking instrument is able to be used to mark over said portion of the marked equator of the golf ball.

12. The apparatus of claim 11 further comprising:

a means to indicate that the golf ball is spinning in stable alignment.

13. The apparatus of claim 12, wherein the indication means includes a lighting source.

14. The apparatus of claim 12, wherein the indication means includes a timing mechanism in communication with the motor such that the timing mechanism is activated upon the activation of said motor, and said lighting source activates when a predetermined time lapses.

15. The apparatus of claim 12, wherein the indication means includes a tachometer in communication with the motor and said lighting source activates when the motor rotates to a predetermined RPM.

16. The apparatus of claim 12, wherein the indication means includes a timing mechanism and a tachometer, and said lighting source activates when the motor rotates to a predetermined RPM for a predetermined amount of time.

* * * * *